US005484236A

United States Patent [19]

Gravier

[11] Patent Number: 5,484,236

[45] Date of Patent: Jan. 16, 1996

[54] METHOD OF FORMING CONCRETE RETAINING WALL BLOCK

[75] Inventor: Robert A. Gravier, Bloomington, Minn.

[73] Assignee: Allan Block Corporation, Edina, Minn.

[21] Appl. No.: 142,715

[22] Filed: Oct. 25, 1993

[51] Int. Cl.[6] ..... F02D 29/02

[52] U.S. Cl. ..... 405/286; 52/592.6; 52/609; 405/262; 405/284

[58] Field of Search ..... 405/262, 284, 405/285, 286; 52/609, 608, 593, 589

[56] References Cited

U.S. PATENT DOCUMENTS

| | | |
|---|---|---|
| 2,624,928 | 1/1953 | Long . |
| 4,524,551 | 6/1985 | Scheiwiller . |
| 4,619,560 | 10/1986 | Crinnion et al. . |
| 4,711,606 | 12/1987 | Leling et al. . |
| 4,909,010 | 3/1990 | Gravier . |
| 4,920,712 | 5/1990 | Dean, Jr. . |
| 4,990,032 | 2/1991 | Smith . |
| 4,993,206 | 2/1991 | Pardo . |
| 5,017,049 | 5/1991 | Sievert . |
| 5,031,376 | 7/1991 | Bender et al. . |
| 5,062,610 | 11/1991 | Woolford et al. . |
| 5,120,164 | 6/1992 | Iacocca et al. . |
| 5,181,362 | 1/1993 | Benitez . |

FOREIGN PATENT DOCUMENTS

| | | | |
|---|---|---|---|
| 2622227 | 4/1989 | France | 405/262 |
| 2675835 | 10/1992 | France . | |

*Primary Examiner*—Dennis L. Taylor
*Attorney, Agent, or Firm*—Haugen and Nikolai

[57] ABSTRACT

A method for forming concrete retaining wall blocks from a single mold with selectable dimensions such that a retaining wall of a desired setback can be defined. One of a plurality of core bars is implemented with the mold during the manufacturing process to define a laterally extending rectangular recess of a predetermined width across the lower major surface of a composite block. Subsequently, the composite block is split along a midsection thereof to form a pair of identical blocks, each block having a laterally extending front lip and a laterally extending lower recess. The depth of the recess determines the setback of a retaining wall formed therefrom. The shallower the dimension of the lower recess, the greater the setback of the individual rows forming the retaining wall formed therefrom. Further, the present method facilitates creating a pair of blocks with a textured front surface to provide an aesthetically pleasant retaining wall. A plurality of core bars are available with different widths, and are used to form retaining wall blocks adapted to define retaining walls with varying setbacks ranging from 0° (vertical) to 12°. The core bars can have a rectangular or trapezoidal cross section. Each formed retaining wall block has core openings to reduce the weight thereof.

17 Claims, 3 Drawing Sheets

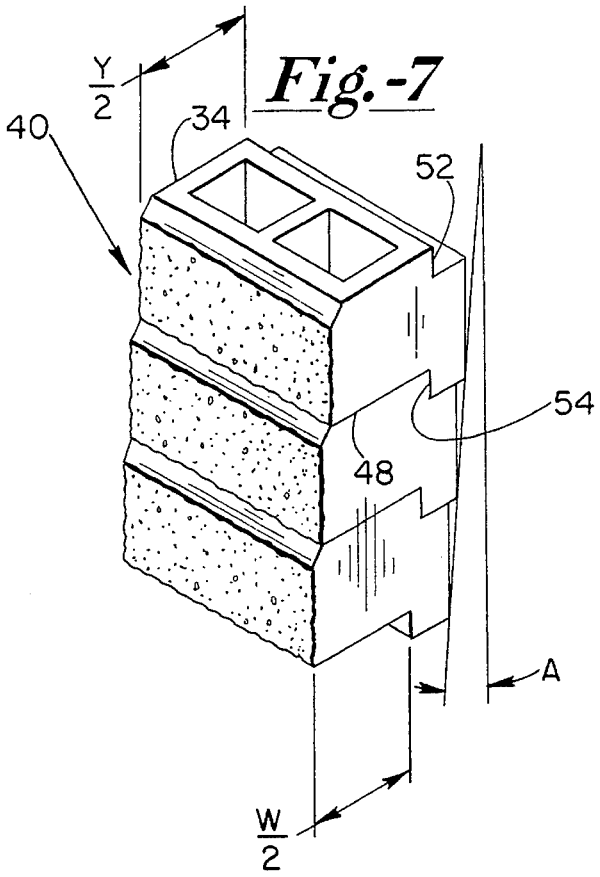
Fig.-7
Fig.-8
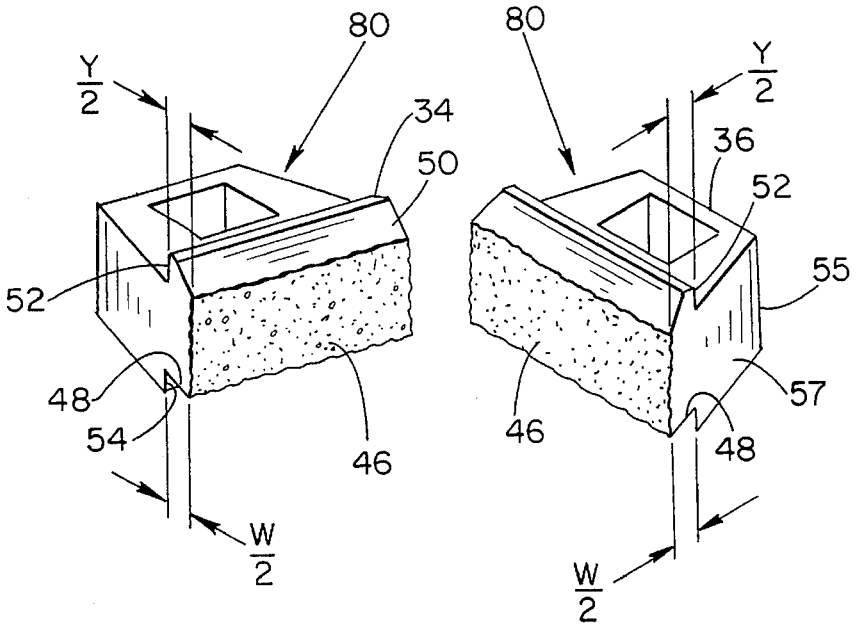

METHOD OF FORMING CONCRETE RETAINING WALL BLOCK

BACKGROUND OF THE INVENTION

I. Field of the Invention

This invention is related generally to the construction of retaining wall blocks, and more particularly to a unique method of forming a pair of identical blocks each with a raised front lip and a lower front recess, the depth of which lower recess can be selectively defined during the manufacturing process to correspond to the setback angle of a retaining wall which can be constructed from the block.

II. Discussion of the Prior Art

Retaining walls are commonly employed to retain highly positioned soil, such as soil forming a hill, to provide a usable level surface therebelow such as for playgrounds and yards, or to provide artificial contouring of the landscape which is aesthetically pleasant. Retaining wall systems are typically designed to have a "setback" at an angle to counter the pressure of the soil disposed behind the wall. Setback is generally considered to be the distance in which one course of a wall extends beyond the front of the next highest course of the same wall. However, setback is not always required for a wall of moderate height, and further, may not be appropriate when constructed close to lot lines, utilities, trees, or structures already in place. Thus, a method of manufacturing retaining wall blocks which accommodates selectively creating blocks of different dimensions such that the blocks can be used to form retaining walls with setbacks from 0° to 12° would be valuable to accommodate the needs of various applications.

It is known in the prior art to form blocks in pairs, whereupon a composite block is split to form a pair of substantially identical blocks to economize the production of the blocks. Further, splitting a composite block allows the formation of an irregular and aesthetically pleasant textured front surface for each of the blocks defined. Thus, splitting a molded composite block has the dual function of facilitating an economical method of producing multiple blocks from a single mold, and which blocks have an aesthetically pleasant exposed front surface.

U.S. Pat. No. 4,909,010 which is assigned to the assignee of the present invention discloses a novel block having a textured front surface, and which is ideal for constructing retaining wall systems with a setback. The blocks interlock to create a strong barrier wall. The setback is determined by the thickness of the front lip. The blocks are formed in pairs by splitting a single molded block. There is no lower channel defined in the molded block, thus, a wall cannot be built with no setback. There is also no method disclosed of using a single mold to define blocks of different shapes and dimensions.

U.S. Pat. No. 5,017,049 to Sievert teaches a composite masonry block which facilitates creating a retaining wall with setback, and which blocks are formed in pairs by splitting a block along a midsection thereof to define a pair of substantially identical blocks. A pair of longitudinally extending grooves are defined parallel to each other, one defined in the upper major surface and the other in the lower major surface of the block. Upon splitting the block, a pair of substantially identical blocks are formed, each having a textured front surface. A pair of opposing flanges are defined on the composite block such that upon splitting, each formed block will have a downwardly extending rear flange to facilitate establishing a predetermined setback. The method taught includes filling the mold cavities in a manner which provides for casting the blocks on their sides. The method taught by this patent facilitates creating blocks in an economical manner, but fails to teach a method of forming a block with selectively defined dimensions, and from a single mold such that the blocks can ultimately form retaining walls with a chosen setback, or with no setback at all.

U.S. Pat. No. 5,031,376 to Bender et al. teaches retaining wall construction and blocks which are also formed in pairs. During manufacturing, a pair of grooves are defined parallel to another, one disposed in each of the major surfaces to facilitate the splitting procedure. A pair of opposing flanges are defined in the upper major surface at opposite ends thereof, which flanges form a front lip to facilitate a retaining wall with a setback. This block and a method of manufacturing thereof does not facilitate selectively defining dimensions of a retaining wall block using a single mold, which blocks can be used to form a retaining wall with a desired setback, or no setback at all. The face proximate the lip is not textured.

U.S. Pat. No. 4,920,712 to Dean, Jr. teaches a concrete retaining wall block which is formed in pairs by splitting a larger block along the midsection thereof, wherein the front and exposed surface of the block is visible when stacked to form a retaining wall. However, there is no method of manufacturing taught using a single mold wherein the block dimensions can be selectively defined to facilitate creating a retaining wall with a selected setback, or no setback at all.

U.S. Pat. No. 5,214,898 to Beretta teaches a block for building retaining walls having a lip and groove arrangement such that the block can be stacked to form a retaining wall with no setback at all. However, there is no method of manufacturing taught wherein the block dimensions can be selectively defined using a single mold such that the blocks can be used to form a retaining wall with a selected setback, nor is there a method of manufacturing taught wherein the blocks are formed in pairs.

OBJECTS

It is accordingly a principle object of the present invention to provide a method of manufacturing a pair of retaining wall blocks from a single mold wherein the block dimensions can be custom defined such the blocks are adapted to form a retaining wall with a desired setback.

It is a further object of the present invention to provide a method of manufacturing a retaining wall block wherein the blocks can be assembled to form a retaining wall with a setback of from 0° to 12°.

Still yet a further object of the present invention is to provide a method of manufacturing a pair of retaining wall blocks wherein each has a textured exposed face when assembled into a wall and thus an aesthetically pleasant appearance.

Another object of the present invention is to provide a method of forming a variety of block shapes, including rectangular and trapezoidal shaped blocks, in pairs.

Other objects, features and advantages of the present invention will become apparent to those skilled in the art through the Description of the Preferred Embodiment, claims, and drawings herein wherein like numerals refer to like elements.

SUMMARY OF THE INVENTION

The foregoing objects and advantages of the present invention are achieved by providing a method of manufacturing a pair of retaining wall blocks wherein a molded composite block is formed with a major upper surface having a ridge laterally extending thereacross, and a lower major surface having a custom defined notch laterally extending thereacross, wherein the upper ridge and lower notch are parallel to one another. The composite block is split across the midsection thereof to bisect the upper ridge and lower notch, and a pair of identical blocks are formed. Each block has a textured exposed front surface, and a laterally extending upper lip and lower recess such that the blocks, when assembled, form a retaining wall with a preselected setback.

More specifically, a single mold is implemented wherein the width of the laterally extending notch is custom defined at the time of manufacturing and before splitting the molded block such that when the blocks are stacked after splitting, the lip of the lower block will mate with the lower recess of the block stacked thereupon. The width of the block recess stacked thereon will determine the setback of the wall to be assembled. The shallower the front recess of each block, the greater the setback of the retaining wall. The width of the lip remains fixed while the width of the recess can vary.

To selectively define the width and shape of the laterally extending notch in the molded block during the time of manufacture, a core bar of a chosen width and shape is used in combination with a single mold to define the laterally extending notch at an identical width. Thus, a single mold can be used with any of a number of core bars, each bar having an appropriate width and shape. A rectangular or trapezoidal shaped core bar is preferred.

During the molding process, the single composite block is first molded with the laterally extending ridge including a longitudinal V-shaped notch extending along the center thereof to bisect the ridge into a pair of lips. After curing, the block is then split through the center of this ridge V-shaped notch and through the center of the lower lateral extending notch such that a pair of blocks each with a front lip with a beveled front surface are defined. The beveled upper lip and textured front surface of each formed block adds to the aesthetic appearance of a formed retaining wall created therefrom. Further, to reduce the weight of each block, a pair of vertically extending cores or hollows are defined in the molded block to each side of the laterally extending ridge, which cores are separated by a core reinforcement portion. This hollowed core arrangement reduces the weight per square foot of the retaining block yet provides sufficient reinforcement strength. More than one shape of blocks can be realized using the method of the present invention, including rectangular and trapezoidal shaped blocks.

In summary, the present invention is directed towards a method of manufacturing a pair of retaining wall blocks with a textured front surface, wherein the block dimensions can be selectively defined while using a single mold before splitting such that the formed blocks will realize a retaining wall with a predetermined selected setback when stacked.

DESCRIPTION OF THE DRAWINGS

FIG. 7 is a perspective view of a retaining wall system formed from blocks manufactured with a large recess such that the blocks have a rear lip; and FIG. 8 is a perspective view of two identical trapezoidal blocks formed by splitting a composite block according to the process of the present invention.

DESCRIPTION OF THE PREFERRED EMBODIMENT

Figure 1:
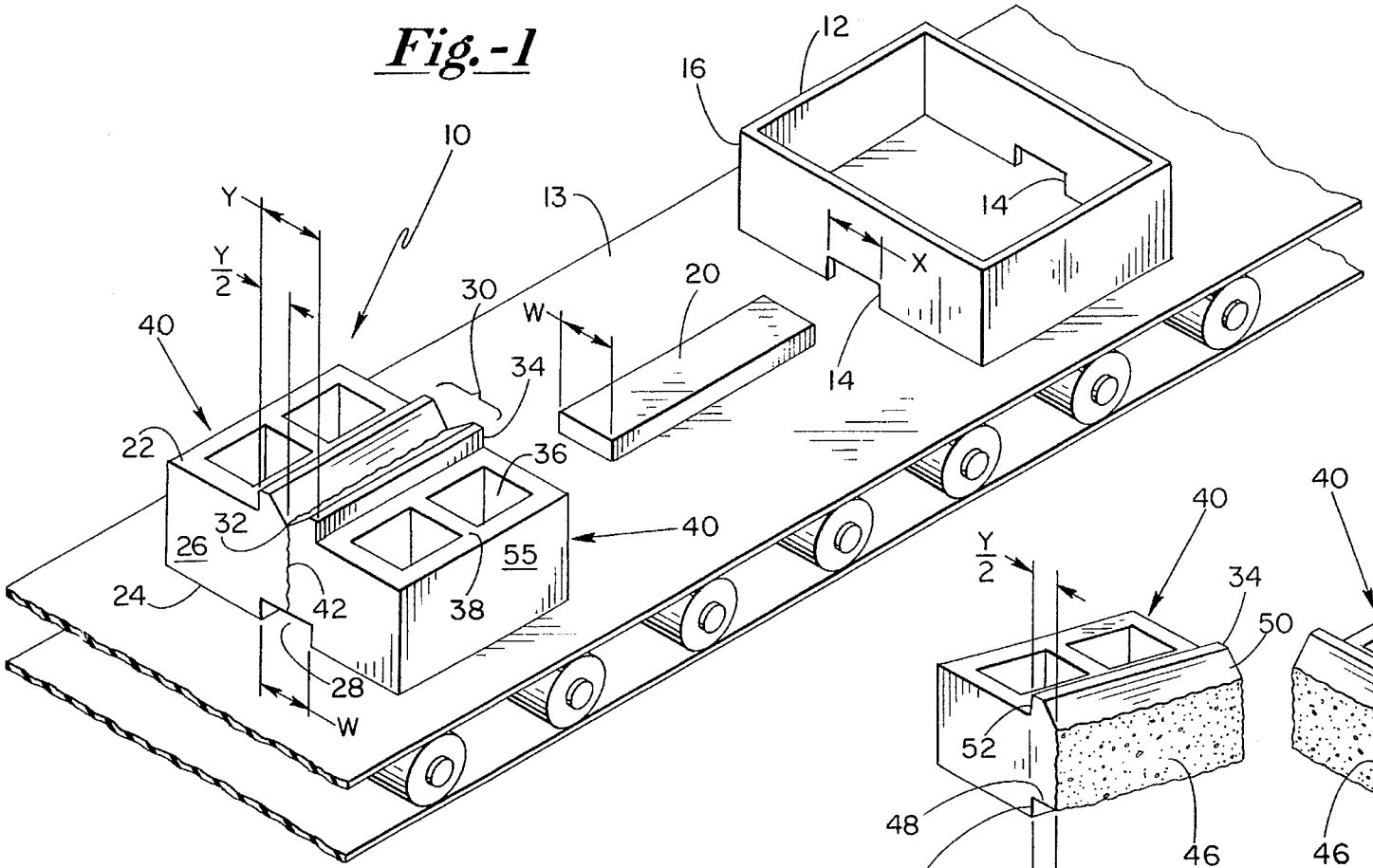
FIG. 1 is a perspective view of a mold box, core bar and a composite block formed therefrom according to the process of the present invention residing on a conveyor belt.

Referring now to FIG. 1 is shown a cured composite block 10 which is cast from a single mold 12 using a process well-known in the art. This process for making the present invention includes block molding the rectangular composite masonry block 10 by filling rectangular block mold 12 with mix and casting the block by compressing the mix in the mold through the application of pressure to the exposed mix at the open upper end of the block mold. Additional discussion of this well-known method is provided in U.S. Pat. No. 5,017,049, the teachings of which are incorporated herein by reference.

The novel features of the present method for manufacturing retaining wall blocks can be appreciated in view of the particular features of mold 12 shown placed on a standard conveyor belt 13. Specifically, mold 12 is comprised of a rectangular structure having an open top and bottom and with a rectangular opening 14 defined in each of opposing sides 16 of mold 12. Each rectangular opening 14 is defined at a center lower portion of each respective side wall 16. Each opening 14 has a predetermined width dimension "X", as shown. An accessory to mold 12 implemented in combination therewith is a core bar 20. Core bar 20 is comprised of a longitudinally extending rectangular member having a width dimension "W", as shown. However, core bar 20 could have a trapezoidal shape as well to provide tapered surfaces (see FIG. 7). Prior to the molding process, core bar 20 is disposed longitudinally such that it extends through both openings 14 and is centered therewithin as will be appreciated shortly. A plurality of core bars 20 are available to be implemented with mold 12, each having a different width "W". However, the width dimension "W" of bar 20 is less than or equal to the width dimension "X" of each opening 14. Core bar 20 defines a laterally extending notch 28 extending across the lower major surface of block 10 including the width thereof as will now be discussed in greater detail.

Still referring to FIG. 1, composite block 10 can be seen to be formed from mold 12 as a rectangular block with an upper major surface 22 and an opposing lower major surface 24. Block 10 has a pair of opposing major sides 26, wherein a laterally extending notch 28 extends therebetween along a center of block 10 to bisect block 10. Notch 28 is formed by the selected core bar 20 disposed through openings 14 of mold 12 during the molding process. Subsequently, when core bar 20 and mold 12 is removed from the formed block 10 notch 28 is defined. Accordingly, the width "W" of notch 28 is identical to the width "W" of the associated core block 20 used during the molding process. The width of notch 28 can be selectively determined during the molding process by choosing the appropriate core bar 20 with a selected width "W". The width "W" of notch 28 directly corresponds to a setback which is established when the blocks formed are stacked and assembled into a retaining wall, as will be discussed shortly.

Block 10 can also be seen to include a laterally extending ridge 30 extending between the opposing major walls 26 along a center thereof to bisect block 10, which ridge 30 is parallel to and vertically defined above laterally extending notch 28. Ridge 30 is further defined as having a V-shaped notch or groove 32 extending the length thereof and bisecting ridge 30 into a pair of lips 34. To reduce the weight of block 10 and the pair of blocks defined therefrom, a pair of vertically extending core openings or hollows 36 are provided each side of ridge 30, each opening 36 extending from upper major surface 22 to major lower surface 24 of block 10. A core reinforcement portion 38 is perpendicularly defined between each respective pair of openings 36 as shown.

Ridge 30 is particularly characterized as having a predetermined width dimension "Y", wherein the width of each lip 34 has a dimension "Y/2". Thus again, elongated V-shaped notch 32 bisects ridge 30 into a pair of identical elongated lips 34. The dimension "Y" remains fixed as the dimension "W" is selectively defined.

Once cured, block 10 is split into a pair of identical rectangular blocks 40. Block 10 is split along line 42, which splitting process can include a manual chisel and hammer as well as machines known to those with skill in the art for such purposes. This splitting process in combination with the symmetrical features of block 10 including lips 34 and lateral extending notch 28 facilitates an economical production of the blocks since only one casting process is required to form two blocks. Further, the present process facilitates creating a pair of identical blocks 40 with a textured front surface which is exposed and visible when the blocks are assembled to form a retaining wall. This textured surface is aesthetically pleasant and adds to the attractiveness of the retaining wall formed. According to the present invention, the pair of blocks 40 formed after the splitting procedure each have a textured front surface with a lateral extending upper lip 34 and the laterally extending lower recess 48 having a depth of "W/2", as can be seen in FIG. 2.

Figure 2:
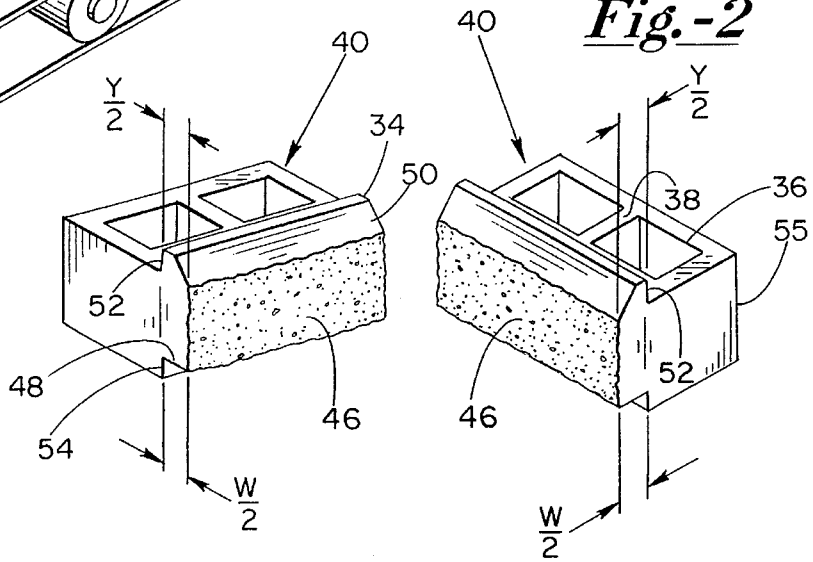
FIG. 2 is a perspective view of two identical rectangular blocks formed by splitting the composite block of FIG. 1.

Referring now to FIG. 2, the pair of blocks 40 formed from the previously discussed method can be seen. Each block 40 has a textured front surface 46 with laterally extending lip 34 disposed thereabove. A laterally extending rectangular recess 48 extends thereunder and has a depth of "W/2", which is half the width dimension "W" of the core bar 20 used and notch 28 originally formed in block 10 and shown in FIG. 1. Again, the width of recess 48 will define the setback of the retaining wall to be formed as will be discussed shortly. Also seen in FIG. 2 is a smooth beveled surface 50 of each laterally extending lip 34 which is formed as a result of V-shaped notch 32 originally defined in block 10 and discussed in reference to FIG. 1. The back surface 52 of each lip 34 is smooth and vertical with respect to the upper major surface of block 40. Similarly, the vertical surface 54 of recess 48 is smooth as well and in combination with surface 52 provides for a tight fitting wall system and fast installation.

In an alternative embodiment, block 10, can be cast to have a generally diamond or hexagon (six-sided) shape and profile such that a pair of trapezoidal blocks 80 are formed after the splitting process. (See FIG. 8). For instance, the opposing distal walls 55 of the block 10 would be shorter in length than textured front wall 46, and the side walls 57 at each block 40 would taper rearwardly and inwardly to respective shorter rear wall 55 to define a trapezoidal block 80 suited for forming curved retaining walls. Hence, limitations to defining a rectangular block 10 and a pair of rectangular blocks 40 is not to be inferred using the method of the present invention.

Figure 3:
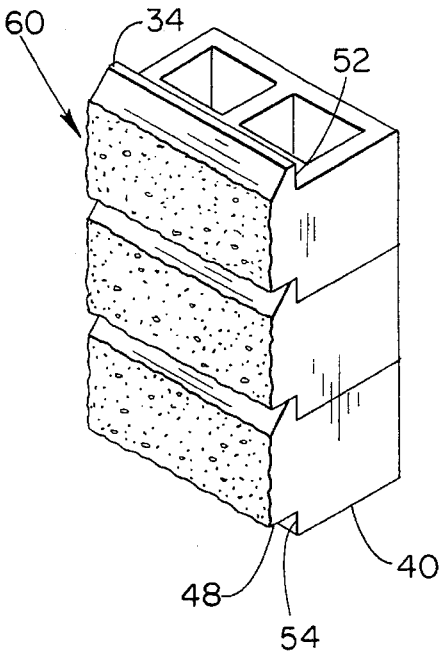
FIG. 3 is a perspective view of a retaining wall system with no setback formed from blocks shown in FIG. 2.
Figure 4:
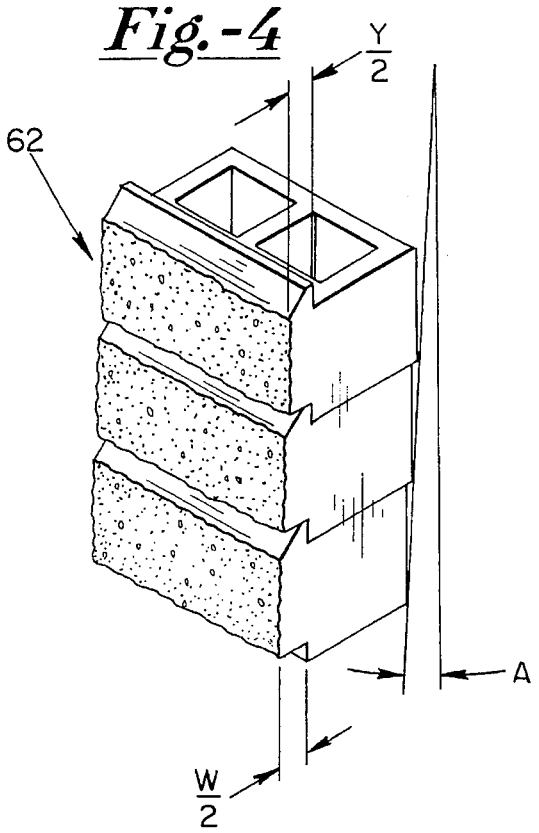
FIG. 4 is a perspective view of a retaining wall system with a setback corresponding to the width of the selectively defined lower recess of the block shown in FIG. 2.

Turning now to FIG. 3 and 4, the novel features of the present method using a single mold 12 can be appreciated in view of retaining walls formed by stacking a plurality of blocks 40 manufactured from the method of the present invention. As shown in FIG. 3, a vertically extending wall 60 with no setback can be formed when the width "W/2" of recess 48 is defined to be equal to the width of lip 34 having a dimension "Y/2". In other words, the block 10 formed in FIG. 1 has a ridge with a width "Y" equal in dimension to width "W" of laterally extending notch 28.

To further appreciate the features of the present method, using a single mold 12, a retaining wall 62 can be formed such as shown in FIG. 4 with a setback having an angle "A". The retaining wall 62 is formed from blocks by defining recess 48 such that it has the depth which is less than the width of the lip 34. In other words, the depth "W/2" of recess 48 is less than the width dimension "Y/2" of lip 34. Thus, when blocks 40 are stacked the front exposed textured surface 46 of each block will be offset rearwardly, as shown, in a staggered arrangement. In other words, the front surface 46 of each block 40 will be offset slightly rearwardly from the front surface 46 of the block disposed thereunder. The offset distance is equal to the difference between the dimension W/2 and the dimension Y/2 (OFFSET=W/2–Y/2), which corresponds to the width of recess 48 and lip 34, respectively. Thus, the greater the difference between the dimensions of recess 48 and lip 34, the greater the offset angle "A".

Accordingly, one of the novel features of the present method invention is that the offset of a retaining wall to be formed from the manufactured blocks 40 can be selectively determined at the time of molding block 10 by implementing the appropriate core bar 20. Further, a single mold 12 is used to manufacture a block 10 having a lateral extending notch 28 of a selectable predetermined width "W". The width "W" of core bar 20 directly corresponds to this setback "A" defined when the blocks 40 are stacked, where front surface 54 of each recess 48 is securingly abutted against the back surface 52 of the corresponding lip 34 of the block disposed thereunder. When stacked, a structurally sound retaining wall is formed with a predetermined setback, or no setback at all.

Figure 5:
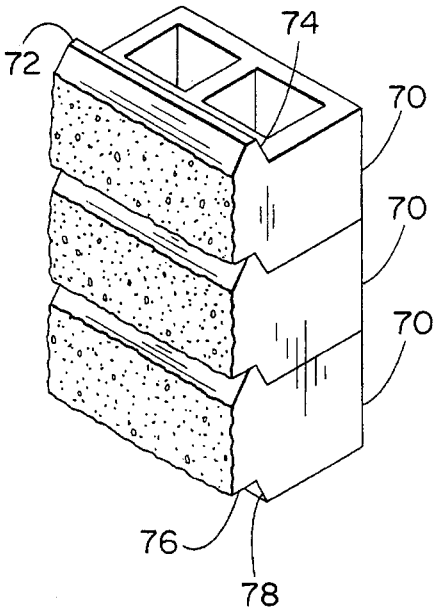
FIG. 5 and 6 is a perspective view of a retaining wall system without and with setback, respectively, wherein the block lip and recess are tapered.
Figure 6:
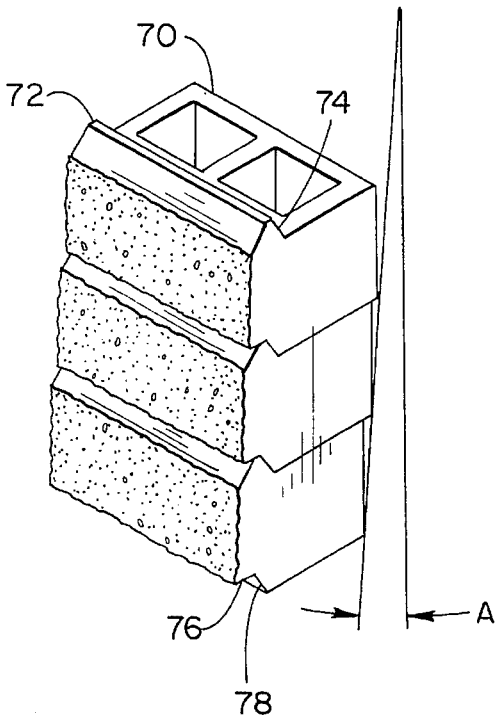

Referring now to FIGS. 5 and 6, a retaining wall formed from blocks using an alternative preferred embodiment of the present method is shown wherein a pair of blocks 70 can be formed from each single composite block, wherein each block 70 has a lip 72 with a tapered rear surface 74. Each laterally extending notch of the composite block is formed to have a trapezoidal shape and which is formed from a corresponding trapezoidal shaped core bar (not shown). Thus, each block 70 has a recess 76 with a tapered wall 78. When the blocks 70 are stacked such as shown in FIGS. 5 and 6, the tapered surfaces 74 and 78 of the corresponding recesses 76 and ridges 72, respectively, are conforming and abut one another. This additional beveled feature of the ridge and recess provides a better bond to occur between the raised lip 72 and the rest of the block by eliminating a suction-like force which occurs during production. This method also provides for improved block quality and faster rates of production.

While the method disclosed for forming blocks is the preferred embodiment, it is to be recognized that block 10 or 70 could be formed with a laterally extending ridge 30 and without any laterally extending groove 32 at all such that the front of each formed block would be comprised of a single textured planar surface. Thus, when assembled into a retaining wall with no setback whatsoever, a retaining wall with a continuous textured surface would be formed. The present method invention is primarily directed to selectively defining the shape and width "W" of lateral extending notch 28 at the time of molding, which width dimension is chosen to correspond to a desired setback which will be formed when the blocks are stacked. V-shaped notch 32, which could also comprise of any other shapes if desired such as a semi-circle, facilitates the splitting process, and further, provides for an aesthetically pleasant beveled lip which can be appreciated when a retaining wall is formed therefrom. Moreover, the width of lip 34 and 72 could be selectively defined as well with the width of the recess 48 and 78 remaining fixed, respectively, to choose setback.

The preferred method invention disclosed realizes retaining wall blocks with an upper forward lip and a lower front recess which provides creating a sound structure which is not susceptible to shifting once embedded in an embankment. Thus, shifting of the retaining wall blocks once integrated into a retaining wall is inhibited.

The width "W/2" of each recess 48 is preferably substantially smaller than the width of the remaining bottom surface of each block 40, as shown in FIG. 2. The width "W/2" of each recess 48 is preferably selectively defined in the range of from 2" to 4", however, limitation to this particular range of dimensions is not to be inferred. The dimension "Y/2" of each lip 34 is preferably defined as about 1½". The width "W" of the various core bars 20 adapted to be used with mold 12 vary in width from 4" to 8". Accordingly, the width dimension "X" of each opening 14 in mold 12 is 8", which is the maximum width available to be defined as the which of laterally extending notch 28 in block 10. Again, limitation to these dimensions is not to be inferred, and are provided by way of illustration. For instance, the width dimension "W" could be large relative to the depth of the block itself such that the block is essentially a rear-lip design, as shown in FIG. 7. Thus, limitation to a range of width "W" is not to be inferred, but rather, is limited only to the chosen dimension "X" of mold 12 and can be defined large to accommodate a rear-lip design. Thus, the shape of the block system can vary with the concept still intact. Neither the dimensions or shape of the block need be limited. This method is conventionally applied to the concrete block production industry, and the larger scale "wet or pre-cast" industry. Finally, the block, can take on either a solid or hollow configuration, and limitation to defining hollows 36 is not to be inferred.

Preferably, mold block 12 has the dimensions of 8"×16"×24". Thus, each core bar 20 has a length dimension of at least 16" as well, and each identical block 40 has a depth of 12". Automatic manufacturing techniques are adapted to be used with the present method where a core-bar puller is used to position each core bar 20 to mold box 12 before and after the molding process. Thus, core bar 20 can be inserted either by hand or by machine to mold box 12 before disposing a block into mold 12 for processing. As shown in FIG. 1, the present invention is ideally performed on a conveyor belt to facilitate a high volume output.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

I claim:

1. A method of creating a construction block adapted to form retaining walls or the like, comprising the steps of:

(a) forming a member having a major upper surface and major lower surface and a plurality of edges, said upper major surface having a ridge extending laterally across a midsection thereof between an opposed pair of said edges with said ridges extending upwardly and away from said upper major surface by a predetermined first dimension, said lower major surface having a notch extending laterally across a midsection thereof between said opposed pair of edges with said notch extending upwardly from said lower major surface by a dimension substantially equal to said predetermined first dimension, wherein said laterally extending ridge is parallel to and disposed vertically above said laterally extending notch; and (b) splitting said member along a center of both said ridge and said notch to define a pair of said construction blocks, wherein each said construction block has rough textured front surface defined by splitting the member in half, a recess extending laterally thereunder, and a lip extending laterally thereover wherein the height of said lip is substantially equal to the depth of said recess.

2. The method as specified in claim 1 further comprising the step of selectively defining the width of said laterally extending notch to correspond to a selected wall setback defined when said blocks are stacked with the lip of a lower said block disposed within and substantially filling the recess of a said block stacked thereupon.

3. The method as specified in claim 2 wherein said laterally extending ridge is defined with a width equal to the width of the defined notch such that a vertically extending wall can be formed using said blocks.

4. The method as specified in claim 3 wherein said member is formed such that both said laterally extending notch and said laterally extending recess bisect said member such that a pair of identical said blocks are formed upon splitting said member.

5. The method as specified in claim 3 wherein said laterally extending ridge is further defined to have a groove laterally extending across a center thereof and bisecting said ridge into a pair of laterally extending lips.

6. The method as specified in claim 5 wherein said groove is formed to have a generally V-shaped cross section.

7. The method as specified in claim 1 further comprising the step of forming at least one vertically extending core each side of said laterally extending ridge and said notch.

8. The method as specified in claim 7 further comprising the step of forming a pair of said cores each side of said laterally extending ridge and said notch, each said pair of cores being separated from each other by a core support web member extending between opposed surfaces of said member and through said ridge.

9. The method as specified in claim 8 wherein each said core support member is defined to extend perpendicular to said laterally extending ridge and said notch.

10. The method as specified in claim 1 further comprising the step of defining said laterally extending notch to have a rectangular cross section.

11. The method as specified in claim 1 further comprising the step of defining said laterally extending notch to have a trapezoidal cross section, and defining said laterally extending ridge to have a pair of tapered surfaces.

12. The method as specified in claim 1 further comprising the step of defining said member to have a rectangular profile such that each said defined pair of construction blocks has a rectangular profile.

13. The method as specified in claim 1 further comprising the step of defining said member to have a generally hexagon profile such that each said defined pair of construction blocks has a front wall, a rear wall, and a pair of side walls each tapering from said front wall to said back wall, wherein said front wall is greater in length than said rear wall.

14. The method as specified in claim 1 further comprising the step for forming a retaining wall from said defined construction blocks.

15. The method as specified in claim 14 wherein said retaining wall is formed to have a setback.

16. The method of creating a construction block adapted to form retaining walls or the like comprising the steps of:

(a) preparing a mold box for receiving raw concrete with the mold box having opposed front and rear walls and opposed side walls and with the opposed lateral side walls having parallelly disposed horizontally aligned rectangular core bar receiving openings formed along the lower edges thereof;

(b) inserting an elongated rectangular core bar within said mold box extending between said parallelly disposed horizontally aligned openings for forming a notch;

(c) loading raw concrete within said mold box while forming cores within said raw concrete along a vertical axis normal to the axis of said core bar to form a member having a major upper surface and major lower surface and a plurality of edges, said major upper surface formed with a ridge; and (d) splitting said member along a center of both said ridge and said notch to define a pair of said construction blocks, wherein each said construction block has rough textured front surface defined by splitting the member in half, a recess extending laterally thereunder, and a lip extending laterally thereover wherein the height of said lip is substantially equal to the depth of said recess.

17. The method as defined in claim 16 being particularly characterized in that said method includes placing said mold box upon the surface of a conveyor belt to form said lower major surface, and with the top surface of said conveyor belt forming said lower major surface.

* * * * *

US005484236C1

(12) EX PARTE REEXAMINATION CERTIFICATE (7387th)

United States Patent

Gravier

(10) Number: US 5,484,236 C1

(45) Certificate Issued: Mar. 2, 2010

(54) METHOD OF FORMING CONCRETE RETAINING WALL BLOCK

(75) Inventor: Robert A. Gravier, Bloomington, MN (US)

(73) Assignee: Allan Block Corporation, Edina, MN (US)

Reexamination Request:
No. 90/009,351, Dec. 5, 2008

Reexamination Certificate for:

| | |
|---|---|
| Patent No.: | **5,484,236** |
| Issued: | **Jan. 16, 1996** |
| Appl. No.: | **08/142,715** |
| Filed: | **Oct. 25, 1993** |

(51) Int. Cl.
*E02D 29/00* (2006.01)
*F02D 29/02* (2006.01)

(52) U.S. Cl. ..... 405/286; 405/262; 405/284; 52/592.6; 52/609

(58) Field of Classification Search ..... 52/315
See application file for complete search history.

(56) References Cited

U.S. PATENT DOCUMENTS

| | | | | |
|---|---|---|---|---|
| D35,120 | S | | 9/1901 | Hockman |
| 1,534,353 | A | * | 4/1925 | Besser ..... 52/315 |
| 1,544,478 | A | | 6/1925 | Payne |
| 1,736,595 | A | | 11/1929 | Heinzman |
| 1,789,400 | A | | 1/1931 | Brozek |
| 1,807,138 | A | | 5/1931 | Spelshouse |
| 2,313,363 | A | | 3/1943 | Schmitt |
| 2,624,928 | A | | 1/1953 | Long |
| 3,060,542 | A | | 10/1962 | Martin |
| 4,229,123 | A | | 10/1980 | Heinzmann |
| 4,524,551 | A | | 6/1985 | Scheiwiller |
| 4,619,560 | A | | 10/1986 | Crinnion et al. |
| 4,711,606 | A | | 12/1987 | Leling et al. |
| 4,909,010 | A | | 3/1990 | Gravier |
| 4,920,712 | A | | 5/1990 | Dean, Jr. |
| D313,280 | S | | 12/1990 | Rodenburgh |
| 4,990,032 | A | | 2/1991 | Smith |
| 4,993,206 | A | | 2/1991 | Pardo |
| 5,017,049 | A | | 5/1991 | Sievert |
| 5,031,376 | A | | 7/1991 | Bender et al. |
| 5,062,610 | A | | 11/1991 | Woolford |
| 5,108,282 | A | | 4/1992 | Pardo |
| 5,120,164 | A | | 6/1992 | Iacacca et al. |
| 5,181,362 | A | | 1/1993 | Benitez |
| 5,183,616 | A | | 2/1993 | Hedrick |
| D350,611 | S | | 9/1994 | Scales |

FOREIGN PATENT DOCUMENTS

| | | |
|---|---|---|
| CH | 612238 | 7/1979 |
| CH | 663437 | 12/1987 |
| DE | 8423385 | 12/1984 |
| DE | 3626117 | 4/1987 |
| DE | 2626117 | 12/1997 |
| EP | 102637 | 5/1986 |
| FR | 2622227 | 4/1989 |
| FR | 2675835 | 10/1992 |
| JP | 60 37736 | 2/1985 |
| SU | 0844657 | 7/1981 |

* cited by examiner

*Primary Examiner*—Aaron J. Lewis

(57) ABSTRACT

A method for forming concrete retaining wall blocks from a single mold with selectable dimensions such that a retaining wall of a desired setback can be defined. One of a plurality of core bars is implemented with the mold during the manufacturing process to define a laterally extending rectangular recess of a predetermined width across the lower major surface of a composite block. Subsequently, the composite block is split along a midsection thereof to form a pair of identical blocks, each block having a laterally extending front lip and a laterally extending lower recess. The depth of the recess determines the setback of a retaining wall formed therefrom. The shallower the dimension of the lower recess, the greater the setback of the individual rows forming the retaining wall formed therefrom. Further, the present method facilitates creating a pair of blocks with a textured front surface to provide an aesthetically pleasant retaining wall. A plurality of core bars are available with different widths, and are used to form retaining wall blocks adapted to define retaining walls with varying setbacks ranging from 0° (vertical) to 12°. The core bars can have a rectangular or trapezoidal cross section. Each formed retaining wall block has core openings to reduce the weight thereof.

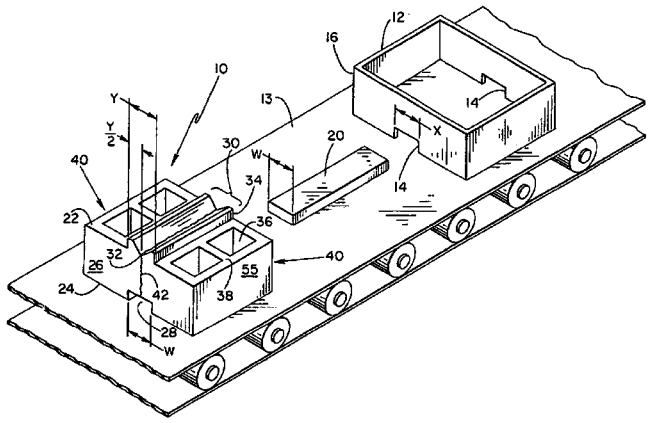

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 2 is cancelled.

Claims 1, 3 and 16 are determined to be patentable as amended.

Claims 4–15 and 17, dependent on an amended claim, are determined to be patentable.

New claims 18–67 are added and determined to be patentable.

1. A method of creating a construction block adapted to form retaining walls [or the like], comprising the steps of:

(a) forming a member having a major upper surface and major lower surface and a plurality of edges, said upper major surface having a ridge extending laterally across a midsection thereof between an opposed pair of said edges with said ridges extending upwardly and away from said upper major surface by a predetermined first dimension, said lower major surface having a notch extending laterally across a midsection thereof between said opposed pair of edges with notch extending upwardly from said lower major surface by a dimension substantially equal to said predetermined first dimension, wherein said laterally extending ridge is parallel to and disposed vertically above said laterally extending notch; [and]

(b) splitting said member along a center of both said ridge and said notch to define a pair of said construction blocks, wherein each said construction block has rough textured front surface defined by splitting the member in half, a recess extending laterally thereunder, and a lip extending laterally thereover wherein the height of said lip is substantially equal to the depth of said recess*; and*

*(c) selectively defining the width of said laterally extending notch to correspond to a selected wall setback defined when said blocks are stacked with the lip of a lower said block disposed within and substantially filling the recess of a said block stacked thereupon.*

3. The method as specified in claim [2] *1* wherein said laterally extending ridge is defined with a width equal to the width of the defined notch such that a vertically extending wall can be formed using said blocks.

16. The method of creating a construction block adapted to form retaining walls [or the like] comprising the steps of:

(a) preparing a mold box for receiving raw concrete with the mold box having opposed front and rear walls and opposed side walls and with the opposed lateral side walls having parallely disposed horizontally aligned rectangular core bar receiving openings formed along the lower edges thereof;

(b) inserting an elongated rectangular core bar within said mold box extending between said parallelly disposed horizontally aligned openings for forming a notch;

(c) loading raw concrete within said mold box while forming cores within said raw concrete along a vertical axis normal to the axis of said core bar to form a member having a major upper surface and major lower surface and a plurality of edges, said major upper surface formed with a ridge; and (d) splitting said member along a center of both said ridge and said notch to define a pair of said construction blocks, wherein each said construction block has rough textured front surface defined by splitting the member in half, a recess extending laterally thereunder, and a lip extending laterally thereover wherein the height of said lip is substantially equal to the depth of said recess.

*18. The method of claim 16, further comprising selecting a selected wall setback, and selecting a core bar having a width to provide the selected wall setback, the wall setback being defined by the difference in widths between the laterally extending lip and the recess.*

*19. The method of claim 18, wherein the selection of said core bar is from a plurality of core bars of different widths, the different widths providing choices for the selected wall setback.*

*20. The method of claim 19, wherein the different widths provide choices for a setback angle that varies from between 0 degrees and 12 degrees.*

*21. The method of claim 18, wherein the selection of said core bar is from a plurality of core bars of different shapes.*

*22. The method of claim 21, wherein said selected wall setback provides a setback angle between 0 degrees and 12 degrees.*

*23. The method of claim 16, further comprising stripping the member from the mold box before the member has cured.*

*24. The method of claim 16, wherein the cores extend vertically on each side of said laterally extending ridge and said notch.*

*25. The method of claim 16, wherein the cores extend vertically without intersecting said laterally extending ridge and said notch.*

*26. The method of claim 16, wherein said member is formed such that both said laterally extending notch and said laterally extending recess bisect said member such that a pair of identical said blocks are formed upon splitting said member.*

*27. The method of claim 16, wherein the opposed side walls of the mold box form corresponding side walls of the member such that each said defined pair of construction blocks has a front wall, a rear wall, and a pair of side walls each tapering from said front wall to said back wall.*

*28. The method of claim 27, wherein the mold box forms the member with a generally hexagon profile, such that the front wall is greater in length than the rear wall of each said defined pair of construction blocks.*

*29. The method of claim 1, further comprising selecting a core bar having a width to provide the selected wall setback, the wall setback being defined by the difference in widths between the laterally extending lip and the recess.*

*30. The method of claim 29, wherein the selection of said core bar is from a plurality of core bars of different widths, the different widths providing choices for the selected wall setback.*

*31. The method of claim 30, wherein the different widths provide choices for a setback angle that varies from between 0 degrees and 12 degrees.*

*32. The method of claim 29, wherein the selection of said core bar is from a plurality of core bars of different shapes.*

*33. The method of claim 32, wherein said selected wall setback provides a setback angle between 0 degrees and 12 degrees.*

*34. The method of claim 1, further comprising preparing a mold box for receiving raw concrete, said mold box having opposed front and rear walls and opposed side walls, and loading raw concrete within said mold box while forming cores within said raw concrete to form the member.*

*35. The method of claim 34, further comprising stripping the member from the mold box before the member has cured.*

*36. The method of claim 34, wherein the opposed side walls have parallelly disposed, horizontally aligned, core bar receiving openings formed along the lower edges thereof, and inserting an elongated core bar within said mold box extending between said parallelly disposed horizontally aligned openings for forming the notch.*

*37. The method of claim 34, wherein the cores extend vertically without intersecting said laterally extending ridge and said notch.*

*38. A method of creating a construction block adapted to form retaining walls, comprising the steps of:*

*(a) preparing a mold box for receiving raw concrete, said mold box having opposed front and rear walls and opposed side walls and with the opposed side walls having parallelly disposed, horizontally aligned, core bar receiving openings formed along the lower edges thereof;*

*(b) inserting an elongated core bar within said mold box extending between said parallelly disposed horizontally aligned openings for forming a notch;*

*(c) loading raw concrete within said mold box while forming cores within said raw concrete along a vertical axis normal to the axis of said core bar thereby forming a member having a major upper surface and major lower surface and a plurality of edges, said upper major surface having a ridge extending laterally across a midsection thereof between an opposed pair of said edges with said ridges extending upwardly and away from said upper major surface by a predetermined first dimension, said lower major surface having the notch formed by said core bar, said notch extending laterally across a midsection thereof between said opposed pair of edges with said notch extending upwardly from said lower major surface by a dimension substantially equal to said predetermined first dimension, wherein said laterally extending ridge is parallel to and disposed vertically above said laterally extending notch; and*

*(d) splitting said member along a center of both said ridge and said notch to define a pair of said construction blocks, wherein each said construction block has rough textured front surface defined by splitting the member in half, a recess extending laterally thereunder, and a lip extending laterally thereover wherein the height of said lip is substantially equal to the depth of said recess.*

*39. The method of claim 38, further comprising selecting a selected wall setback, and selecting a core bar having a width to provide the selected wall setback, the wall setback being defined by the difference in widths between the laterally extending lip and the recess.*

*40. The method of claim 39, wherein the selection of said core bar is from a plurality of core bars of different widths, the different widths providing choices for the selected wall setback.*

*41. The method of claim 40, wherein the different widths provide choices for a setback angle that varies from between 0 degrees and 12 degrees.*

*42. The method of claim 39, wherein the selection of said core bar is from a plurality of core bars of different shapes.*

*43. The method of claim 42, wherein said selected wall setback provides a setback angle between 0 degrees and 12 degrees.*

*44. The method of claim 38, wherein the core bar has a trapezoidal cross-section that forms said notch with a trapezoidal cross-section, whereby each recess is formed with a tapering surface.*

*45. The method of claim 38, where in the core bar has a rectangular cross-section that forms said notch with a rectangular cross-section.*

*46. The method of claim 38, further comprising stripping the member from the mold box before the member has cured.*

*47. The method of claim 38, wherein the cores extend vertically on each side of said laterally extending ridge and said notch.*

*48. The method of claim 38, wherein the cores extend vertically without intersecting said laterally extending ridge and said notch.*

*49. The method of claim 38, wherein said member is formed such that both said laterally extending notch and said laterally extending recess bisect said member such that a pair of identical said blocks are formed upon splitting said member.*

*50. The method of claim 38, wherein the opposed side walls of the mold box form corresponding side walls of the member such that each said defined pair of construction blocks has a front wall, a rear wall, and a pair of side walls each tapering from said front wall to said back wall.*

*51. The method of claim 50, wherein the mold box forms the member with a generally hexagon profile, such that the front wall is greater in length than the rear wall of each said defined pair of construction blocks.*

*52. A method of creating a construction block adapted to form retaining walls, comprising the steps of:*

*(a) forming a member having a major upper surface and major lower surface and a plurality of edges, said upper major surface having a ridge extending laterally across a midsection thereof between an opposed pair of said edges with said ridges extending upwardly and away from said upper major surface by a predetermined first dimension, said lower major surface having a notch extending laterally across a midsection thereof between said opposed pair of edges with said notch extending upwardly from said lower major surface by a dimension substantially equal to said predetermined first dimension, wherein said laterally extending ridge is parallel to and disposed vertically above said laterally extending notch;*

*(b) splitting said member along a center of both said ridge and said notch to define a pair of said construction blocks, wherein each said construction block has rough textured front surface defined by splitting the member in half, a recess extending laterally thereunder, and a lip extending laterally thereover wherein the height of said lip is substantially equal to the depth of said recess; and*

*(c) selectively defining the width of said laterally extending notch to correspond to a selected wall setback defined when said blocks are stacked with the lip of a lower said block disposed within the recess of a said block stacked thereupon.*

*53. The method of claim 52, further comprising selecting a core bar having a width to provide the selected wall setback, the wall setback being defined by the difference in widths between the laterally extending lip and the recess.*

*54. The method of claim 53, wherein the selection of said core bar is from a plurality of core bars of different widths, the different widths providing choices for the selected wall setback.*

*55. The method of claim 54, wherein the different widths provide choices for a setback angle that varies from between 0 degrees and 12 degrees.*

*56. The method of claim 53, wherein the selection of said core bar is from a plurality of core bars of different shapes.*

*57. The method of claim 56, wherein said selected wall setback provides a setback angle between 0 degrees and 12 degrees.*

*58. The method of claim 52, further comprising defining said laterally extending notch to have a trapezoidal cross section, and defining said laterally extending ridge to have a pair of tapered surfaces.*

*59. The method of claim 52, further comprising defining said laterally extending notch to have a rectangular cross section.*

*60. The method of claim 52, further comprising preparing a mold box for receiving raw concrete, said mold box having opposed front and rear walls and opposed side walls, and loading raw concrete within said mold box while forming cores within said raw concrete to form the member.*

*61. The method of claim 60, further comprising stripping the member from the mold box before the member has cured.*

*62. The method of claim 60, wherein the opposed side walls have parallelly disposed, horizontally aligned, core bar receiving openings formed along the lower edges thereof, and inserting an elongated core bar within said mold box extending between said parallelly disposed horizontally aligned openings for forming the notch.*

*63. The method of claim 60, wherein the cores extend vertically on each side of said laterally extending ridge and said notch.*

*64. The method of claim 60, wherein the cores extend vertically without intersecting said laterally extending ridge and said notch.*

*65. The method of claim 60, wherein the opposed side walls of mold box form corresponding side walls of the member such that each said defined pair of construction blocks has a front wall, a rear wall, and a pair of side walls each tapering from said front wall to said back wall.*

*66. The method of claim 60, wherein the mold box forms the member with a generally hexagon profile, such that the front wall is greater in length than the rear wall of each said defined pair of construction blocks.*

*67. The method of claim 52, wherein said member is formed such that both said laterally extending notch and said laterally extending recess bisect said member such that a pair of identical said blocks are formed upon splitting said member.*

* * * * *